US006646381B2

(12) United States Patent
Hasegawa et al.

(10) Patent No.: US 6,646,381 B2
(45) Date of Patent: Nov. 11, 2003

(54) CATHODE-RAY TUBE APPARATUS

(75) Inventors: Takahiro Hasegawa, Gyoda (JP); Junichi Kimiya, Kumagaya (JP); Shunji Ookubo, Kumagaya (JP); Hiroyuki Oda, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 74 days.

(21) Appl. No.: 09/974,840

(22) Filed: Oct. 12, 2001

(65) Prior Publication Data

US 2002/0043921 A1 Apr. 18, 2002

(30) Foreign Application Priority Data

Oct. 13, 2000 (JP) ..... 2000-313854
Sep. 10, 2001 (JP) ..... 2001-273826

(51) Int. Cl.[7] ..... H01J 23/16
(52) U.S. Cl. ..... 315/3; 315/382; 313/414
(58) Field of Search ..... 315/3, 59, 71, 315/15, 17, 382; 313/412, 413, 414, 447

(56) References Cited

U.S. PATENT DOCUMENTS 5,077,497 A * 12/1991 Kamohara et al. ..... 315/3
5,162,695 A * 11/1992 Shimona et al. ..... 313/412
5,694,004 A 12/1997 Kimiya et al. ..... 315/15
6,472,832 B1 * 10/2002 Kimiya et al. ..... 315/382
6,479,926 B1 * 11/2002 Awano et al. ..... 313/414

FOREIGN PATENT DOCUMENTS

JP 10-27555 1/1998
JP 2000-77008 3/2000

* cited by examiner

*Primary Examiner*—Hoang Nguyen
*Assistant Examiner*—Jimmy T. Vu
(74) *Attorney, Agent, or Firm*—Oblon, Spivak, McClelland, Maier & Neustadt, P.C.

(57) ABSTRACT

A main lens of an electron gun assembly comprises a sixth grid, a seventh grid, an eighth grid, and a ninth grid. An asymmetric lens section is created between a fifth grid and the sixth grid on a cathode side of the main lens. The asymmetric lens section has such asymmetry that lens functions of the asymmetric lens section acting on the electron beams are different between the horizontal direction and the vertical direction, and has a lens power varying in synchronism with the deflection of the electron beams. In this asymmetric lens, the asymmetry for a center beam differs from that for side beams.

12 Claims, 6 Drawing Sheets

CATHODE-RAY TUBE APPARATUS

CROSS-REFERENCE TO RELATED APPLICATIONS

This application is based upon and claims the benefit of priority from the prior Japanese Patent Applications No. 2000-313854, filed Oct. 13, 2000; and No. 2001-273826, filed Sep. 10, 2001, the entire contents of both of which are incorporated herein by reference.

BACKGROUND OF THE INVENTION

1. Field of the Invention

The present invention generally relates to a cathode-ray tube (CRT) apparatus, and more particularly to a color cathode-ray tube apparatus capable of reducing a difference between a focusing power of a lens function acting on a center beam and a focusing power of a lens function acting on side beams, thus obtaining a uniform resolution over the entire area of a screen.

2. Description of the Related Art

An in-line self-convergence type color CRT apparatus includes an in-line type electron gun assembly for emitting three in-line electron beams. The performance of a main lens of the electron gun assembly is expressed by lens constants, e.g. a lens magnification and a spherical aberration coefficient. In particular, these two constants substantially determine the performance of the lens.

The less the lens constants, the better the lens performance. As these lens constants decrease, the electron beams can be focused with smaller beam spots on the screen. Accordingly, a higher resolution can be obtained.

One means, which has been proposed to enhance the lens performance, is an electron gun assembly having an electric field expansion type main lens that increases a main lens region in a tube axis direction and virtually enlarges the diameter of the main lens. This electric field expansion type main lens is composed by increasing a distance (lens gap) between the electrodes of the main lens and disposing at least one intermediate electrode between the electrodes.

The lens performance of the electron gun assembly is not sufficient to provide the color CRT apparatus with a good resolution over the entire area of the screen. Specifically, the electron beams emitted from the electron gun assembly are deflected over the entire screen by deflection magnetic fields produced by a deflection yoke. The deflection magnetic fields, however, have field distribution configurations distorted, e.g. in a barrel shape or a pincushion shape, in order to substantially converge the three electron beams at one point over the entire screen.

The distortion in the deflection magnetic fields disadvantageously deforms the beam spot shapes of the electron beams that have landed on the phosphor screen. A beam spot on a peripheral portion of the screen comprises a high-luminance core portion, which is horizontally elongated due to under-focusing, and a low-luminance blur portion, which has been vertically elongated due to over-focusing. This degrades the resolution of the screen.

A so-called dynamic focus type electron gun assembly has been proposed as a means for solving the problem of the deformation of the beam spot due to the distortion of deflection magnetic fields. The electron gun assembly includes an asymmetric lens having a lens power varying in synchronism with the deflection of the electron beam, thereby to cancel the deformation of the beam spot due to the deflection magnetic fields.

The asymmetric lens has a lens function of focusing, with a weak vertical focusing power, the electron beams to be focused on a peripheral portion of the screen. In addition, the beam spot on the peripheral portion of the screen is horizontally focused in an almost optimal state. Thus, the asymmetric lens is designed to maintain a fixed focusing power in an optimal state by canceling the variation of the lens power of the main lens in the horizontal direction.

Side beam passage holes in the respective electrodes of the main lens are made eccentric in order to statically converge the three electron beams at substantially one point on the screen. As a result, the trajectories of the side beams in the main lens are inclined to the center axis of the electron gun assembly.

Accordingly, the side beams passing through the side beam passage holes are affected by the lens function of the main lens over a longer distance than the center beam. Thus, the side beams are over-focused, compared to the center beam. Consequently, a blur occurs on the screen, and this degrades the resolution.

In particular, at the peripheral portion of the screen, the image point distance from the main lens to the phosphor screen is longer than at the central portion of the screen. This increases the difference between the focusing power of the lens function acting on the center beam and the focusing power of the lens function acting on the side beams. The side beams reaching the peripheral portion of the screen are greatly over-focused, and blurred beam spots are created. This greatly degrades the resolution at the peripheral portion of the screen. This tendency becomes more conspicuous in an electron gun assembly wherein plural intermediate electrodes are used and the main lens region is greatly increased. In other words, as the diameter of the electric field expansion type main lens is increased to enhance the lens performance, the resolution will deteriorate more considerably.

BRIEF SUMMARY OF THE INVENTION

The present invention has been made in consideration of the above problems, and the object of the invention is to provide a cathode-ray tube apparatus capable of reducing a difference between a focusing power of a lens function acting on a center beam and a focusing power of a lens function acting on side beams, thus obtaining a uniform and high resolution over the entire area of a screen.

In order to solve the problems and achieve the object, the invention of claim 1 provides a cathode-ray tube apparatus including:

an electron gun assembly having an electron beam generating section which generates three electron beams consisting of a center beam and a pair of side beams positioned on both sides of the center beam, and a main lens section which focus the electron beams generated by the electron beam generating section onto a phosphor screen; and a deflection yoke which deflects the electron beams emitted from the electron gun assembly in a horizontal direction and a vertical direction, wherein the main lens section comprises a focus electrode, to which a focus voltage of a first level is applied, an anode, to which an anode voltage of a second level higher than the first level is applied, and at least one intermediate electrode which is disposed between the focus electrode and the anode and to which a voltage of a substantially intermediate level between the first level and the second level is applied, the focus electrode has, in a first end face thereof opposed to the intermediate electrode, three electron beam passage holes for passing the three electron beams, the electron gun assembly includes an asymmetric lens section which has such asymmetry that lens functions of the asymmetric lens section acting on the electron beams are different between the horizontal direction and the vertical direction, and which has a lens power varying in synchronism with the deflection of the electron beams, and the asymmetric lens section is created at a position away by a distance or less, which corresponds to a diameter of the electron beam passage hole formed in the first end face, from the first end face of the focus electrode toward the electron beam generating section, the asymmetric lens section having an asymmetry of a lens function acting on the center beam, which differs from an asymmetry of a lens function acting on the side beams.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of a cathode-ray tube (CRT) apparatus will now be described with reference to the accompanying drawings.

Figure 3:
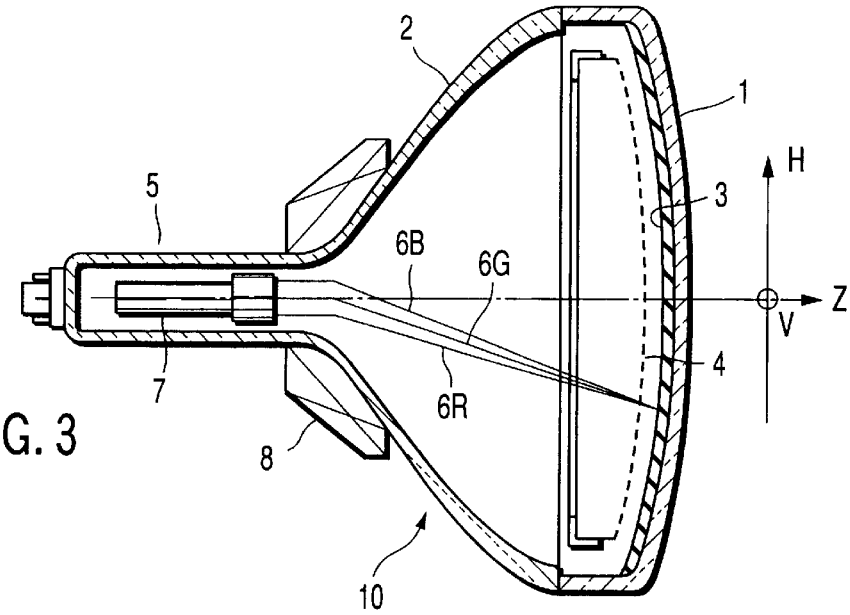
FIG. 3 is a horizontal cross-sectional view schematically showing the structure of a color CRT apparatus serving as a CRT apparatus according to an embodiment of the invention.

As is shown in FIG. 3, the CRT apparatus of this embodiment, e.g. a color CRT apparatus, has a vacuum envelope 10 including a panel 1 and a funnel 2 integrally coupled to the panel 1. A phosphor screen 3 (target) is disposed on an inside surface of the panel 1. The phosphor screen 3 has three-color striped or dot-shaped phosphor layers, which emit blue (B), green (G) and red (R) light components. A shadow mask 4 is disposed to face the phosphor screen 3. The shadow mask 4 has many apertures in its inside part.

An in-line electron gun assembly 7 is disposed within a neck 5, which corresponds to a thinnest portion of the funnel 2. The in-line electron gun assembly 7 emits three electron beams 6B, 6G and 6R (i.e. a center beam 6G and side beams 6B and 6R), which are arranged in line in a horizontal direction H, onto the phosphor screen 3 in a tube axis direction Z. In the in-line electron gun assembly 7, center positions of side beam passage holes in a low-potential side grid and a high-potential side grid, which are parts of a main lens section, are made eccentric to each other. Thereby, the three electron beams are self-converged on a central portion of the phosphor screen 3.

A deflection yoke 8 is mounted on the outside of the funnel 2. The deflection yoke 8 generates non-uniform deflection magnetic fields for deflecting the three electron beams 6B, 6G and 6R, which have been emitted from the electron gun assembly 7, in the horizontal direction H and vertical direction V. The non-uniform deflection magnetic fields comprise a pincushion-shaped horizontal deflection magnetic field and a barrel-shaped vertical deflection magnetic field.

The three electron beams 6B, 6G and 6R emitted from the electron gun assembly 7 are focused on the associated phosphor layers on the phosphor screen 3, while they are being self-converged toward the phosphor screen 3. The three electron beams 6B, 6G and 6R are scanned by the non-uniform deflection magnetic fields in the horizontal direction H and vertical direction V of the phosphor screen 3. Thus, a color image is displayed.

Figure 1:
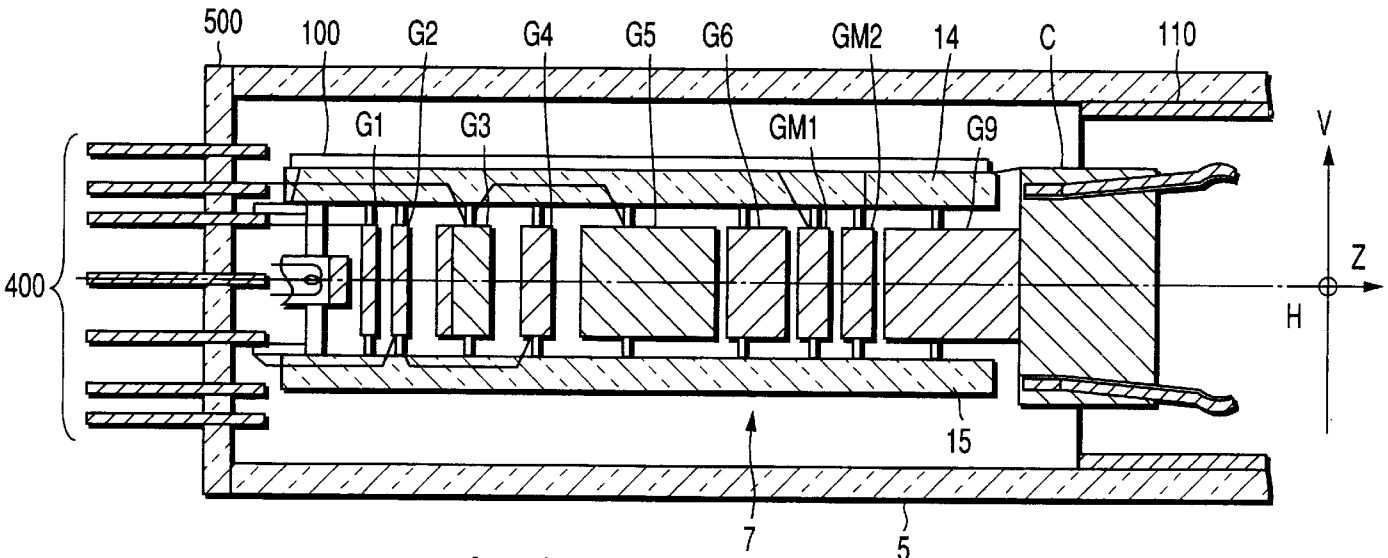
FIG. 1 is a vertical cross-sectional view schematically showing the structure of an electron gun assembly applied to a cathode-ray tube (CRT) apparatus according to an embodiment of the present invention.
Figure 2:
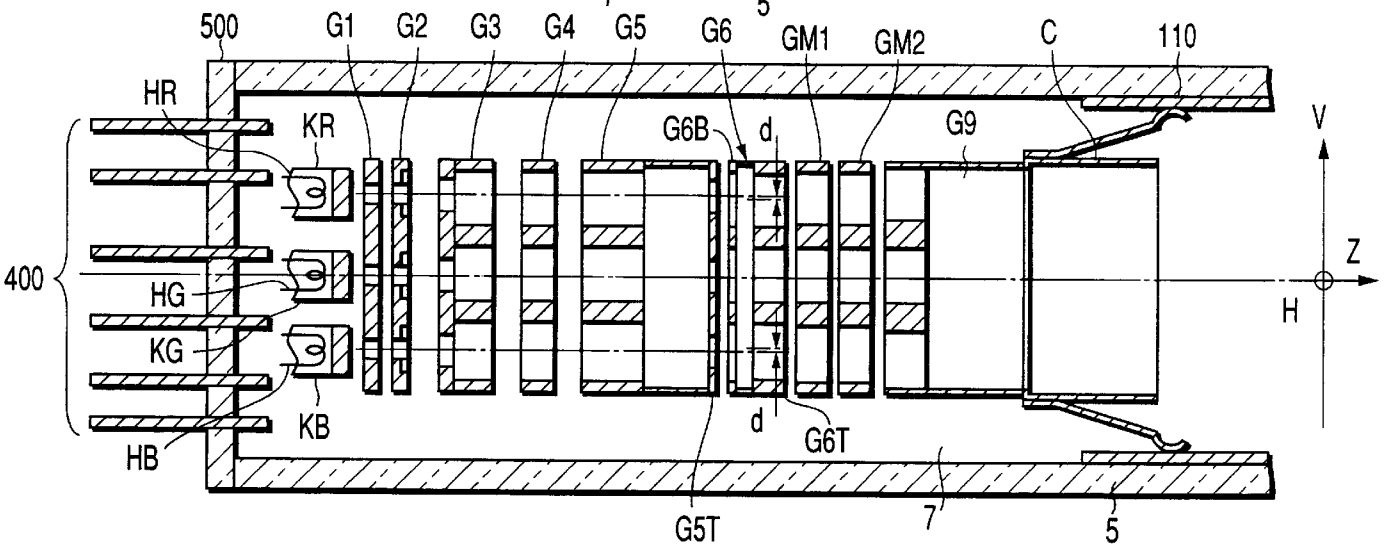
FIG. 2 is a horizontal cross-sectional view schematically showing the structure of the electron gun assembly shown in FIG. 1.

As is shown in FIGS. 1 and 2, the electron gun assembly 7 applied to the CRT apparatus includes cathodes KR, KG and KB with heaters HR, HG and HB. The cathodes K (R, G, B) are arranged in line in the horizontal direction H.

The electron gun assembly 7 also includes a first grid G1, a second grid G2, a third grid G3, a fourth grid G4, a fifth grid G5 (first focus electrode) a sixth grid G6 (second focus electrode), a seventh grid GM1 (first intermediate electrode), an eighth grid GM2 (second intermediate electrode), a ninth grid G9 (anode), and a sealed cup C. The cathodes K and the nine grids are arranged in succession in a direction Z of travel of electron beams and fixed by a pair of insulated support members 14 and 15. The sealed cup C is fixed to the ninth grid G9 by welding.

As is shown in FIG. 1, a resistor 100 is disposed near the insulated support member 14. One end of the resistor 100 is connected to the sealed cup C. The other end of the resistor 100 is connected to one of stem pins 400 of a stem section 500 for electrical connection between the grids and the outside of the tube. The other end of the resistor 100 is thus grounded on the outside of the tube.

Figure 4:
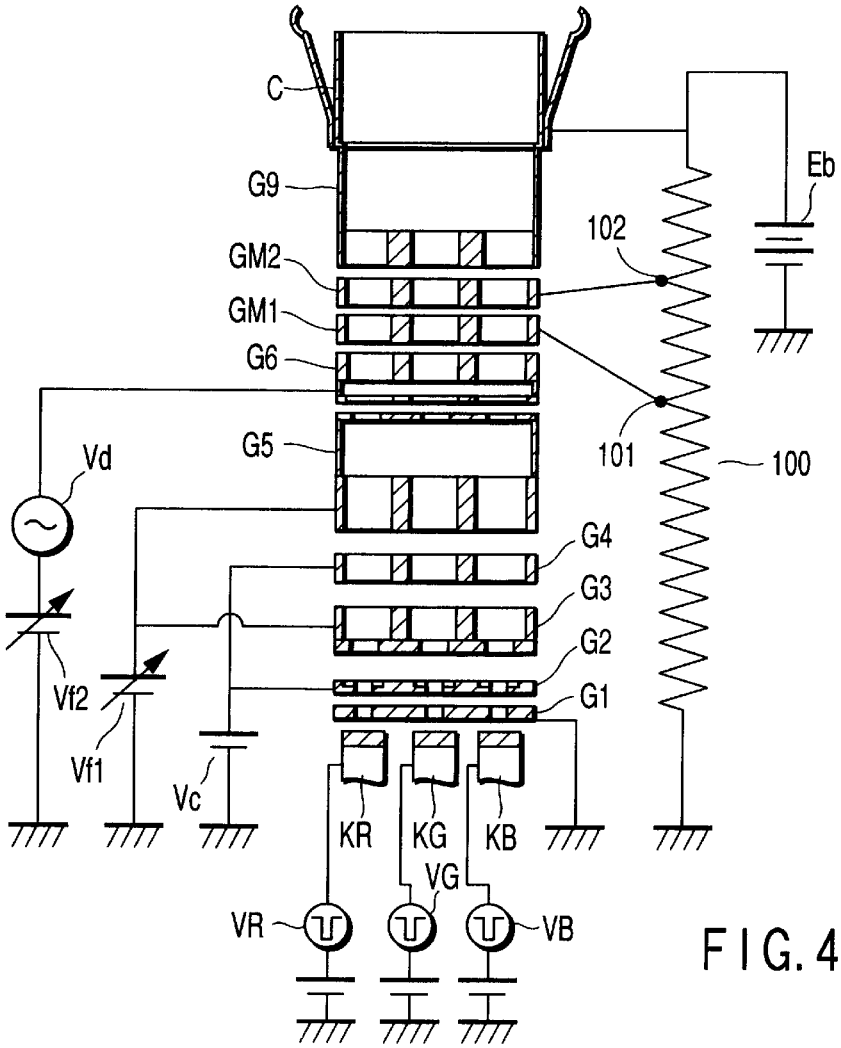
FIG. 4 schematically shows the connection between the grids of the electron gun assembly shown in FIG. 1.

As is shown in FIG. 4, the resistor 100 has, at its middle portion, voltage supply terminals 101 and 102 for supplying voltages to the grids of the electron gun assembly 7. The voltage supply terminals 101 and 102 are connected to the seventh grid GM1 and eighth grid GM2, respectively. The seventh grid GM1 and eighth grid GM 2 are supplied with voltages, which are obtained by dividing at predetermined ratios an anode voltage Eb supplied via an internal conductor film 110, the sealed cup C and ninth grid G9.

The first grid G1 to sixth grid G6 are connected to associated stem pins 400 of the stem section 500 welded to the end portion of the neck. The first grid G1 to sixth grid G6 are supplied with predetermined voltages from the outside via the stem pins 400.

As is shown in FIG. 4, the respective cathodes KR, KG and KB are supplied with voltages obtained by superimposing video signals VR, VG and VB associated with an image upon a DC voltage of about 120 V.

The first grid G1 is grounded. The second grid G2 and fourth grid G4 are connected within the tube and supplied with a constant acceleration voltage Vc from the outside of the CRT. The acceleration voltage Vc is a DC voltage of about 700 V.

The third grid G3 and fifth grid G5 are connected within the tube and supplied with a constant first focus voltage Vf1 from the outside of the CRT. The first focus voltage Vf1 is a voltage corresponding to about 20% to 40% of the anode voltage Eb, e.g. a DC voltage of 6 to 9 kV.

The sixth grid G6 is supplied with a dynamic focus voltage (Vf2+Vd), which is obtained by superimposing an AC voltage component Vd synchronized with the deflection magnetic fields generated by the deflection yoke upon a second focus voltage Vf2, which is substantially equal in potential to the first focus voltage Vf1. Like the first focus voltage Vf1, the second focus voltage Vf2 is a voltage corresponding to about 20% to 40% of the anode voltage Eb, e.g. a DC voltage of 6 to 9 kV. The AC voltage component Vd is a voltage of about 300 to 600V varying in synchronism with the deflection magnetic fields.

The ninth grid G9 and sealed cup C are supplied with the anode voltage Eb from the outside of the tube via the internal conductor film 110 coated on the inside wall of the neck. The anode voltage Eb is a DC voltage of about 25 kV.

The seventh grid GM1 is supplied with a voltage corresponding to about 40% of the anode voltage Eb via the voltage supply terminal 101 of resistor 100. Similarly, the eighth grid GM2 is supplied with a voltage corresponding to about 65% of the anode voltage Eb via the voltage supply terminal 102 of resistor 100.

As is shown in FIG. 2, the cathodes K (R, G, B) are arranged in line in the horizontal direction H with regular intervals of about 5 mm. Each of the first grid G1 to ninth grid G9 has three electron beam passage holes for passage of three electron beams 6 (R, G, B) emitted from the respective cathodes.

Specifically, the first grid G1 is a thin-plate electrode and has small-diameter circular electron beam passage holes, each having a diameter of, e.g. 1 mm or less.

Figure 5A:
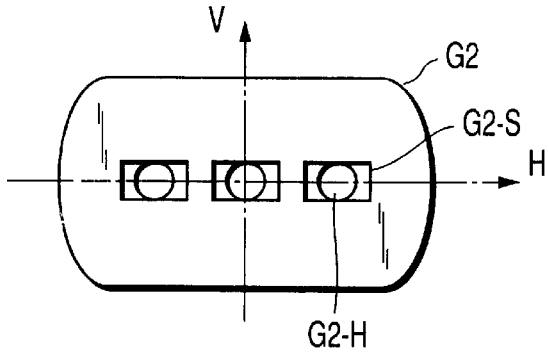
FIG. 5A is a plan view schematically showing the structure of the surface of a second grid, which faces a third grid, the second grid being applied to the electron gun assembly shown in FIG. 1.
Figure 5B:
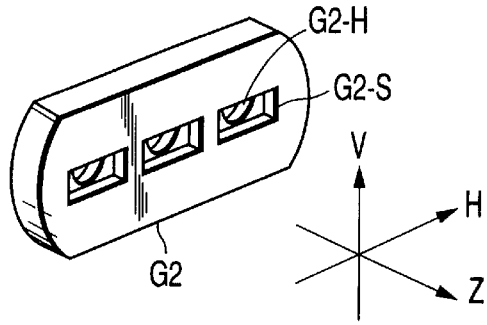
FIG. 5B is a perspective view schematically showing the structure of the second grid.

The second grid G2 is a thin-plate electrode and has circular electron beam passage holes, each having a diameter slightly greater than the diameter of the hole in the first grid G1, e.g. a diameter of 1 mm or less. As is shown in FIGS. 5A and 5B, the second grid G2 has, in its surface opposed to the third grid G3, slits G2-S which are elongated in the horizontal direction H so as to surround circular electron beam passage holes G2-H.

The third grid G3 is formed by coupling two plate-shaped electrodes. The plate-shaped electrode facing the second grid G2 has circular electron beam passage holes, each having a diameter slightly greater than the diameter of the hole in the second grid G2, e.g. a diameter of about 2 mm. The plate-shaped electrode facing the fourth grid G4 has large-diameter circular electron beam passage holes each having a diameter of about 4 to 6 mm.

The fourth grid G4 is a thick plate-shaped electrode and has large-diameter circular electron beam passage holes each having a diameter of about 4 to 6 mm.

The fifth grid G5 comprises a thick plate-shaped electrode and a cup-shaped electrode extending in the tube axis direction Z. The plate-shaped electrode facing the fourth grid G4 has large-diameter electron beam passage holes each having a dimension of about 4 to 6 mm.

Figure 7:
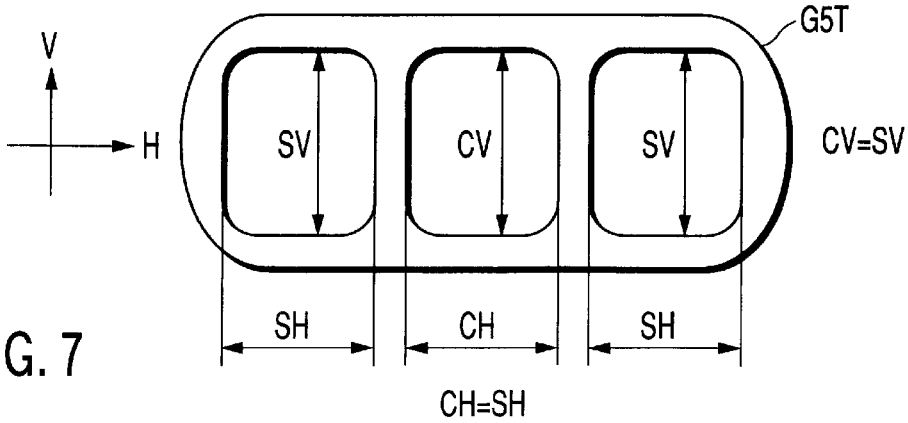
FIG. 7 is a plan view showing the shapes of three electron beam passage holes formed in a cup-shaped electrode end face of a fifth grid applied to the electron gun assembly shown in FIG. 1.

As is shown in FIG. 7, the end face of the cup-shaped electrode G5T facing the sixth grid G6 has vertically elongated electron beam passage holes which have major axes in the vertical direction V. In the cup-shaped electrode G5T, a vertical dimension CV of the center beam passage hole for passing the center beam is equal to a vertical dimension SV of each side beam passage hole for passing the side beam. In addition, in the cup-shaped electrode G5T, a horizontal dimension CH of the center beam passage hole is equal to a horizontal dimension SH of each side beam passage hole.

Figure 6:
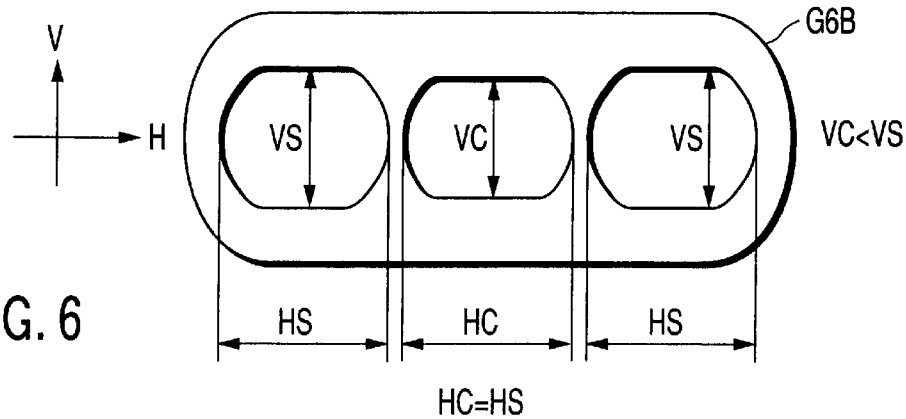
FIG. 6 is a plan view showing the shapes of three electron beam passage holes formed in a cup-shaped electrode end face of a sixth grid applied to the electron gun assembly shown in FIG. 1.

The sixth grid G6 comprises a cup-shaped electrode elongated in the tube axis direction Z and a thick plate-shaped electrode. As is shown in FIG. 6, the end face (second end face) of the cup-shaped electrode G6B facing the fifth grid G5 has horizontally elongated electron beam passage holes which have major axes in the horizontal direction H. In the cup-shaped electrode G6B, a vertical dimension VC of the center beam passage hole is less than a vertical dimension VS of each side beam passage hole. In addition, in the cup-shaped electrode G6B, a horizontal dimension HC of the center beam passage hole is equal to a horizontal dimension HS of each side beam passage hole.

Thereby, an asymmetric lens section is created between the cup-shaped electrode G5T of fifth grid G5 and the cup-shaped electrode G6B of sixth grid G6. The asymmetric lens section has such asymmetry that its lens function acting on the electron beams differs in the horizontal direction H and vertical direction V. The asymmetric lens section is a quadrupole lens having, in a relative fashion, a diverging function in the vertical direction V and a focusing function in the horizontal direction H. The lens power of the quadrupole lens varies in synchronism with the deflection of electron beams.

Figure 8:
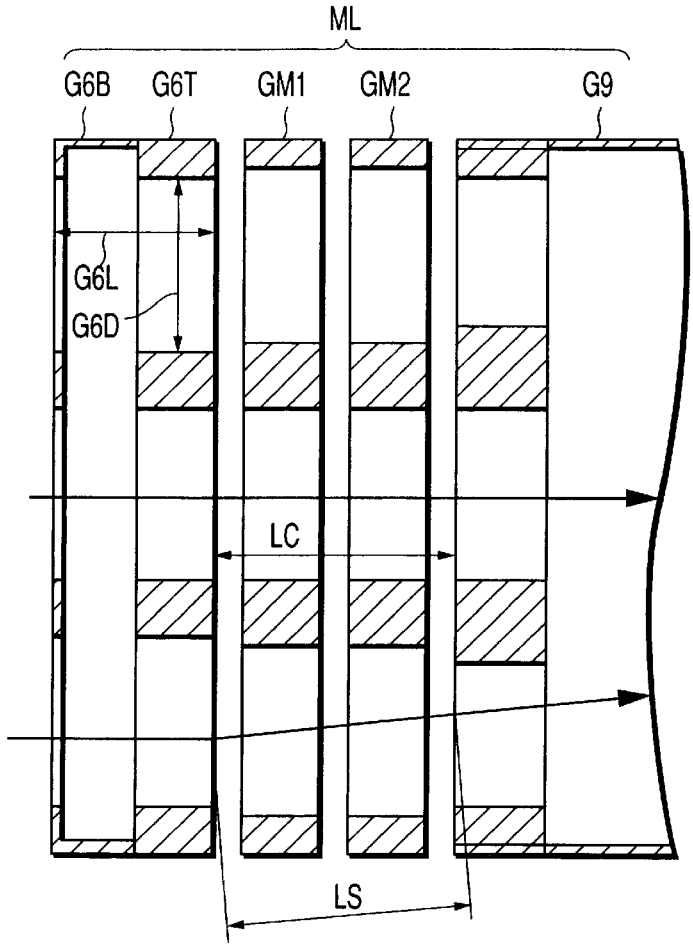
FIG. 8 is a view for explaining the trajectory of the center beam and the trajectory of the side beam passing through the main lens of the electron gun assembly shown in FIG. 1.

A plate face (first end face) of the plate-shaped electrode G6T of sixth grid G6, which faces the seventh grid GM1, has three large-diameter electron beam passage holes each having a diameter of, e.g. 4.34 mm. As is shown in FIG. 8, a distance G6L between the end face of the plate-shaped electrode G6T and the end face of the cup-shaped electrode G6B is not greater than a diameter G6D (=4.34 mm) of the electron beam passage hole in the plate-shaped electrode G6T, and is, for example, 3.6 mm.

The seventh grid GM1 and eighth grid GM2 comprise thick plate-shaped electrodes. The plate-shaped electrode constituting the seventh grid GM1 has large-diameter electron beam passage holes each having a diameter of, e.g. about 4 to 6 mm. The plate-shaped electrode constituting the eighth grid GM2 has large-diameter electron beam passage holes each having a diameter of, e.g. about 4 to 6 mm.

The ninth grid G9 comprises a thick plate-shaped electrode and a cylindrical electrode. The plate-shaped electrode facing the eighth grid GM2 has large-diameter electron beam passage holes each having a dimension of about 4 to 6 mm.

The sealed cup C has its end face abutted upon and welded to the end face of the cylindrical electrode of ninth grid G9.

The first grid G1 and second grid G2 are opposed to each other with a very small distance of 0.5 mm or less. The second grid G2 to ninth grid G9 are arranged and opposed to each other with intervals of about 0.5 mm to 1 mm.

In the electron gun assembly 7 with the above-described structure, the cathodes K, first grid G1 and second grid G2 constitute an electron beam generating section for generating electron beams. The second grid G2 and third grid G3 constitute a prefocus lens PL for prefocusing the electron beams emitted from the electron beam generating section. The third grid G3 to fifth grid G5 constitute a sub-lens SL for further prefocusing the electron beams, which have been prefocused by the prefocus lens.

The fifth grid G5 and sixth grid G6 constitute an asymmetric lens section, that is, a quadrupole lens, which has lens powers varied by the dynamic focus voltage Vd varying in accordance with the deflection amount of electron beams, and has different lens powers in the vertical direction V and in the horizontal direction H. The asymmetric lens section has, in a relative fashion, a diverging function in the vertical direction V and a focusing function in the horizontal direction H.

The sixth grid G6 to ninth grid G9 constitute an electric field expansion type main lens ML for ultimately focusing the electron beams, which have passed through the quadrupole lens QL, on the phosphor screen.

The cathodes K (R, G, B) are heated by the heaters H (R, G, B) disposed therein and are set in such a state as to be able to easily emit thermions. At this time, an electric field produced by the acceleration voltage Vc of about 700 V applied to the second grid G2 reaches the surface of each cathode K (R, G, B). When the electric field that has reached the surface of the cathode K (R, G, B) exceeds the cathode application voltage of about 120 V, electrons come out of the cathode surfaces.

The first grid G1 controls the electric field of the second grid G2 in order to let the electron beams pass through substantially central points of the electron beam passage holes with predetermined sizes formed in the first grid G1 to ninth grid G9. Thus, electron beams are formed by only those electrons which have passed through the electron beam passage holes in the first grid G1. These electron beams are formed so as to pass through substantially central points of the electron lenses created between the second grid G2 through the ninth grid G9. In this manner, the electron beam generating section functions to form electron beams to be fed to the respective electron lenses including the main lens.

The electron beams cross over near the second grid G2 and then diverge. The electron beams are prefocused by the prefocus lens PL created by the second grid G2 and third grid G3. The prefocused electron beams are further prefocused by the sub-lens SL created by the third grid G3, fourth grid G4 and fifth grid G5.

The prefocused electron beams are ultimately focused on the phosphor screen by the main lens ML created by the sixth grid G6, seventh grid GM1, eighth grid GM2 and ninth grid G9. Thus, a beam spot is formed on the screen.

The prefocus lens PL created by the second grid G2 and third grid G3 has an asymmetric component that provides a relatively stronger focusing function in the vertical direction than in the horizontal direction. This asymmetric component is realized by the horizontal slits G2-S formed in that surface of the second grid G2, which faces the third grid G3. Thereby, the effect on the electron beams due to the distorted deflection magnetic fields can be reduced as much as possible, and the electron beams incident on the main lens ML have horizontally elongated cross-sectional shapes each having a relatively longer dimension in the horizontal direction.

As is shown in FIG. 2, the plate-shaped electrode G6T of the sixth grid G6, which is opposed to the seventh grid GM1, is formed such that its side beam passage holes have center axes made eccentric by a predetermined amount d toward the center beam passage hole. Thereby, the side beam is electrostatically deflected and is converged with the center beam, while passing through the shadow mask.

At this time, as shown in FIG. 8, the side beam enters the main lens ML at an angle. Accordingly, a length LS, over which the side beam is affected by the lens action of the main lens ML, is longer than a length LC, over which the center beam is affected by the lens action of the main lens ML. Thus, the side beam is more affected by the focusing action of the main lens ML than the center beam. As a result, the size beam tends to be over-focused, compared to the center beam.

In a non-deflection mode in which electron beams are focused on a central area of the screen, a predetermined potential difference is provided between the fifth grid G5 and sixth grid G6 (for example, the first focus voltage Vf1 applied to the fifth grid G5 is 6 kV, while the second focus voltage Vf2 applied to the sixth grid G6 is 7 kV). The potential of the sixth grid G6 is set to be higher than that of the fifth grid G5. Thus, the asymmetric lens, i.e. quadrupole lens QL, which is created between the vertically elongated electron beam passage holes formed in the face of the fifth grid G5 opposed to the sixth grid G6, and the horizontally elongated electron beam passage holes formed in the face of the sixth grid G6 opposed to the fifth grid G5, has, in a relative fashion, a focusing function in the horizontal direction H and a diverging function in the vertical direction V, as mentioned above.

Accordingly, the electron beams having horizontally elongated cross-sectional shapes due to the asymmetric lens functions of the prefocus lens PL suffer the lens action of the quadrupole lens QL so as to have vertically elongated cross-sectional shapes, before the electron beams enter the main lens. Ultimately, a substantially circular beam spot can be formed on the screen.

The deflection yoke is disposed near the electron gun assembly, while the screen is disposed away from the electron gun assembly. For this reason, in the deflection magnetic fields produced by the deflection yoke, the electron beams still tend to be horizontally elongated and are not easily affected by the deflection magnetic fields.

In the quadrupole lens QL, the asymmetric lens function acting on the center beam differs from the asymmetric lens function acting on the side beams. Specifically, the vertical dimension of the side beam passage hole in the end face of the cup-shaped electrode G6B of sixth grid G6 is greater than the vertical dimension of the center beam passage hole. Thus, the asymmetric lens function of the quadrupole lens QL acting on the side beam is weaker than the asymmetric lens function acting on the center beam.

Figure 9:
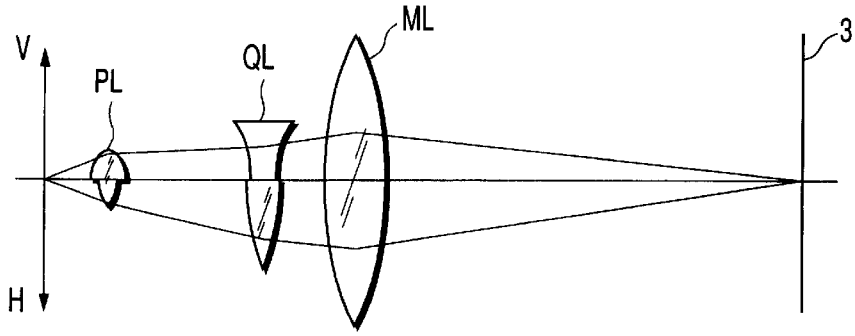
FIG. 9 schematically shows an optical model of a lens acting on the center beam.

This means that a difference between the focusing power in the vertical direction V and the focusing power in the horizontal direction H of the lens function acting on the center beam is greater than a difference between the focusing power in the vertical direction V and the focusing power in the horizontal direction H of the lens function acting on the side beam. In other words, as shown in FIG. 9, the quadrupole lens QL acting on the center beam has a relatively stronger focusing function in the horizontal direction H and a relatively stronger diverging function in the vertical direction V. On the other hand, as shown in FIG. 10, the quadrupole lens QL acting on the side beam has a relatively weaker focusing function in the horizontal direction H and a relatively weaker diverging function in the vertical direction V.

As is shown in FIG. 9, the center beam tends to be horizontally elongated through the prefocus lens PL and is then affected by such a lens action as to tend to be vertically elongated through the quadrupole lens QL. The center beam is optimally focused on the screen by the main lens ML. Thus, a substantially circular beam spot is formed on the screen.

Figure 10:
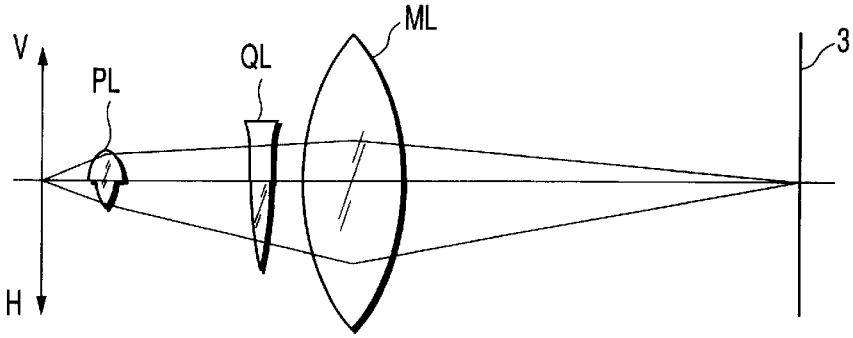
FIG. 10 schematically shows an optical model of a lens acting on the side beam.

On the other hand, as shown in FIG. 10, the side beam tends to be horizontally elongated through the prefocus lens PL and is then affected by a relatively weak asymmetric lens action through the quadrupole lens QL. As regards the horizontal direction H, the side beam, compared to the center beam, is affected by the quadrupole lens QL with an under-focus lens action. As regards the vertical direction V, the side beam, compared to the center beam, is affected by the quadrupole lens QL with an over-focus lens action.

The side beam, coming out of the quadrupole lens QL, enters the main lens ML at an angle. Thereby, the side beam travels through the main lens ML over a longer distance than the center beam. As a result, the side beam, compared to the center beam, is affected by a stronger focusing action of the main lens ML in the horizontal direction H and vertical direction V. In short, the side beam suffers an over-focus lens action of the main lens ML.

In the horizontal direction H, the side beam, like the center beam, is almost optimally focused since the under-focus lens action of the quadrupole lens QL and the over-focus lens action of the main lens ML cancel each other.

In the vertical direction V, the side beam is over-focused by the over-focus lens action of the quadrupole lens QL and the over-focus lens action of the main lens ML. However, the tendency of over-focus is improved in the following manner. Specifically, the cup-shaped electrode G6B of sixth grid G6 for creating the quadrupole lens QL is disposed at a distance of G6L (=3.6 mm) from the end face of the plate-shaped electrode G6T. This distance G6L is less than the diameter G6D of the electron beam passage hole formed in the plate-shaped electrode G6T. The distance G6L permits the electric field creating the main lens to sufficiently permeate into the cup-shaped electrode G6B via the electron beam passage hole in the plate-shaped electrode G6T. The electric field can permeate into the electrode over a distance substantially equal to the diameter of the electron beam passage hole. The vertical dimension of the center beam passage hole in the cup-shaped electrode G6B is less than the vertical dimension of the side beam passage hole. As regards the vertical direction, the focusing power of the main lens acting on the side beam is relatively weak, compared to the focusing power of the main lens acting on the center beam, and there is a tendency of under-focus. The tendency of under-focus cancels the above-mentioned tendency of over-focus.

Accordingly, both the side beams and center beam are optimally focused on the central area of the screen in the horizontal direction H and vertical direction V, and a good beam spot can be obtained.

In a deflection mode in which the electron beams are focused on a peripheral area of the screen, the dynamic focus voltage is applied to the sixth grid G6. The application voltage to the sixth grid G6 becomes higher than in the non-deflection mode in accordance with the deflection of electron beams. As a result, the potential difference between the fifth grid G5 and sixth grid G6 further increases. Thereby, the quadrupole lens QL created between the fifth grid G5 and sixth grid G6 has a stronger lens function than in the non-deflection mode.

As in the non-deflection mode, the quadrupole lens QL has, in a relative fashion, a focusing function in the horizontal direction H and a diverging function in the vertical direction V. In addition, as in the non-deflection mode, the asymmetric lens function of the quadrupole lens QL acting on the side beam is weaker than the asymmetric lens function acting on the center beam.

At the same time, the potential difference between the sixth grid G6, seventh grid GM1, eighth grid GM2 and ninth grid G9 becomes less than in the non-deflection mode in accordance with the increase in the application voltage to the sixth grid G6. Thereby, the lens power of the main lens ML created by these grids decreases. In short, the focusing functions of the main lens ML in the horizontal direction H and vertical direction V weaken, compared to the non-deflection mode.

The electron beams deflected toward the peripheral area of the screen are over-focused in the vertical direction V by the distorted magnetic fields produced by the deflection yoke. However, the over-focus function in the vertical direction V by the deflection magnetic fields can be canceled by the divergence function of the quadrupole lens QL and the focusing function of the main lens ML, which has become weaker than in the non-deflection mode. Thereby, an optimally focused beam spot with no blur can be obtained in the vertical direction V on the peripheral area of the screen.

On the other hand, as regards the horizontal direction H, the center beam deflected toward the peripheral area of the screen can be maintained in the same focused state as in the non-deflection mode, since the over-focus function of the quadrupole lens QL and the focusing function of the main lens ML, which has become weaker than in the non-deflection mode, cancel each other. Thereby, an optimally focused beam spot with no blur can be obtained in the horizontal direction H on the peripheral area of the screen.

As has been described above, the quadrupole lens acting on the side beam has less asymmetry than the quadrupole lens acting on the center beam. Thus, as regards the horizontal direction, the side beam deflected toward the peripheral area of the screen is more affected by the under-focus lens function than the center beam. As regards the vertical direction, the side beam deflected toward the peripheral area of the screen is more affected by the over-focus lens function than the center beam.

Since the side beam enters the main lens ML with an inclination, the side beam is more affected by the lens function of the main lens ML, i.e. the over-focus function, than the center beam. Since the side beam is affected by the under-focus lens function of the quadrupole lens QL with weak asymmetry in the horizontal direction H, the over-focus lens function of the main lens ML can be canceled.

Accordingly, the balance between the main lens ML and quadrupole lens QL is maintained in a fixed state. Thus, the beam spots of the center beam and side beam formed at the peripheral area of the screen are optically focused in the horizontal direction H, and optimal beam spots with no blur can be obtained.

As regards the vertical direction, the side beam is affected by the under-focus lens function by the permeation of the electric field of the main lens ML, and the over-focus lens function is canceled as in the non-deflection mode. Therefore, the beam spots of the center beam and side beams are optimally focused on the peripheral area of the screen.

According to the CRT apparatus, a difference in focusing power of the lens functions acting on the center beam and side beams can be reduced, and a uniform and high resolution can be obtained over the entire screen.

The present invention is not limited to the structure of the above embodiment, and various modifications can be made.

In the above embodiment, in order to electrostatically deflect the side beams, the plate-shaped electrode G6T of the sixth grid G6 is formed such that its side beam passage holes have center axes made eccentric by a predetermined amount d toward the center beam passage hole. The position of deflection is not limited to this, if the side beams are electrostatically deflected before entering the main lens.

Figure 11:
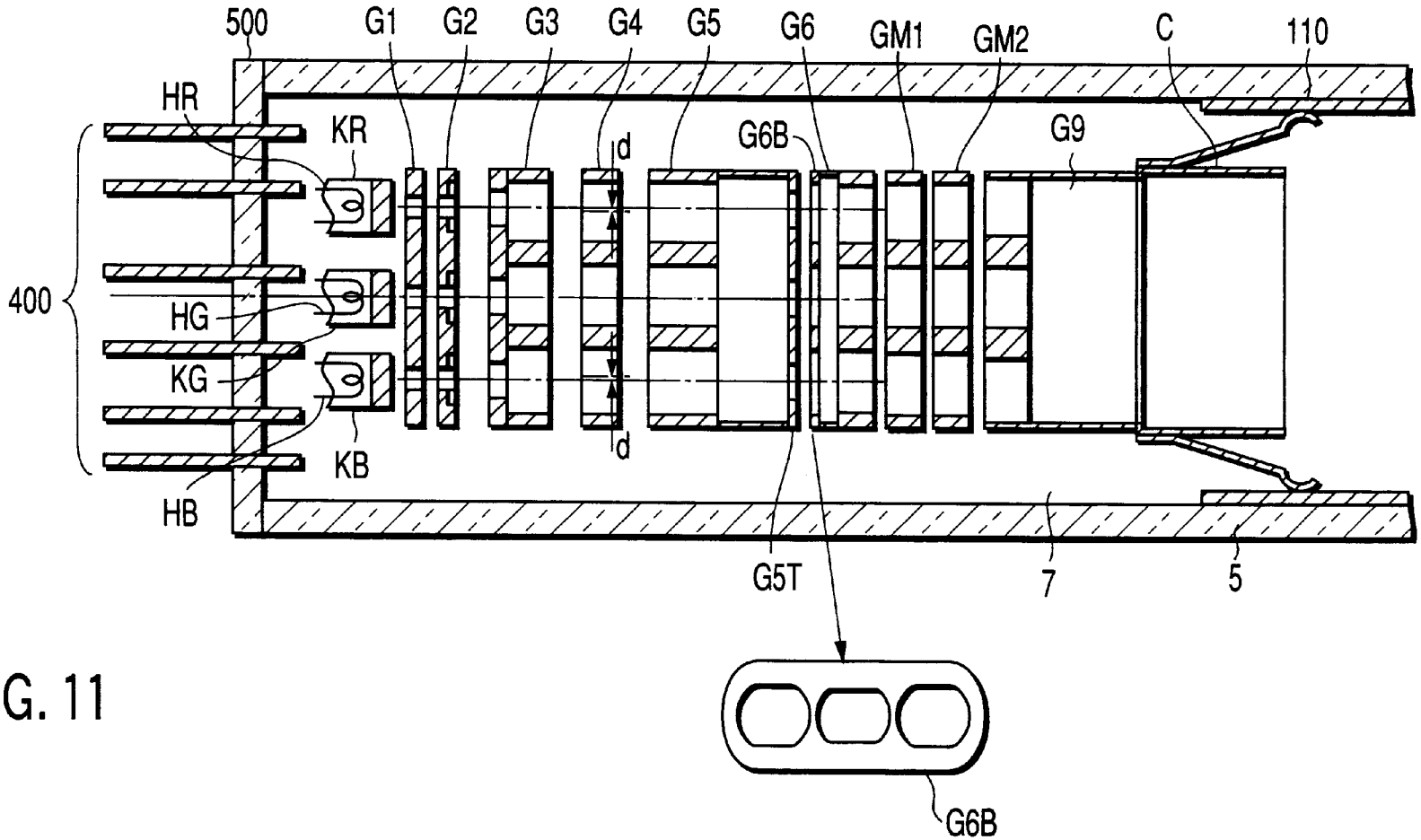
FIG. 11 is a horizontal cross-sectional view schematically showing the structure of an electron gun assembly according to another embodiment of the invention.

For example, as shown in FIG. 11, the fourth grid G4 may have side beam passage holes with center axes made eccentric by a predetermined amount d toward the center beam passage hole.

In the above embodiment, the voltages obtained by dividing the anode voltage Eb through the resistor are supplied to only the seventh grid GM1 serving as the first intermediate electrode and the eighth grid GM2 serving as the second intermediate electrode. However, the number of electrodes to be supplied with voltages through the resistor and the kinds of such electrodes are not limited.

Figure 12:
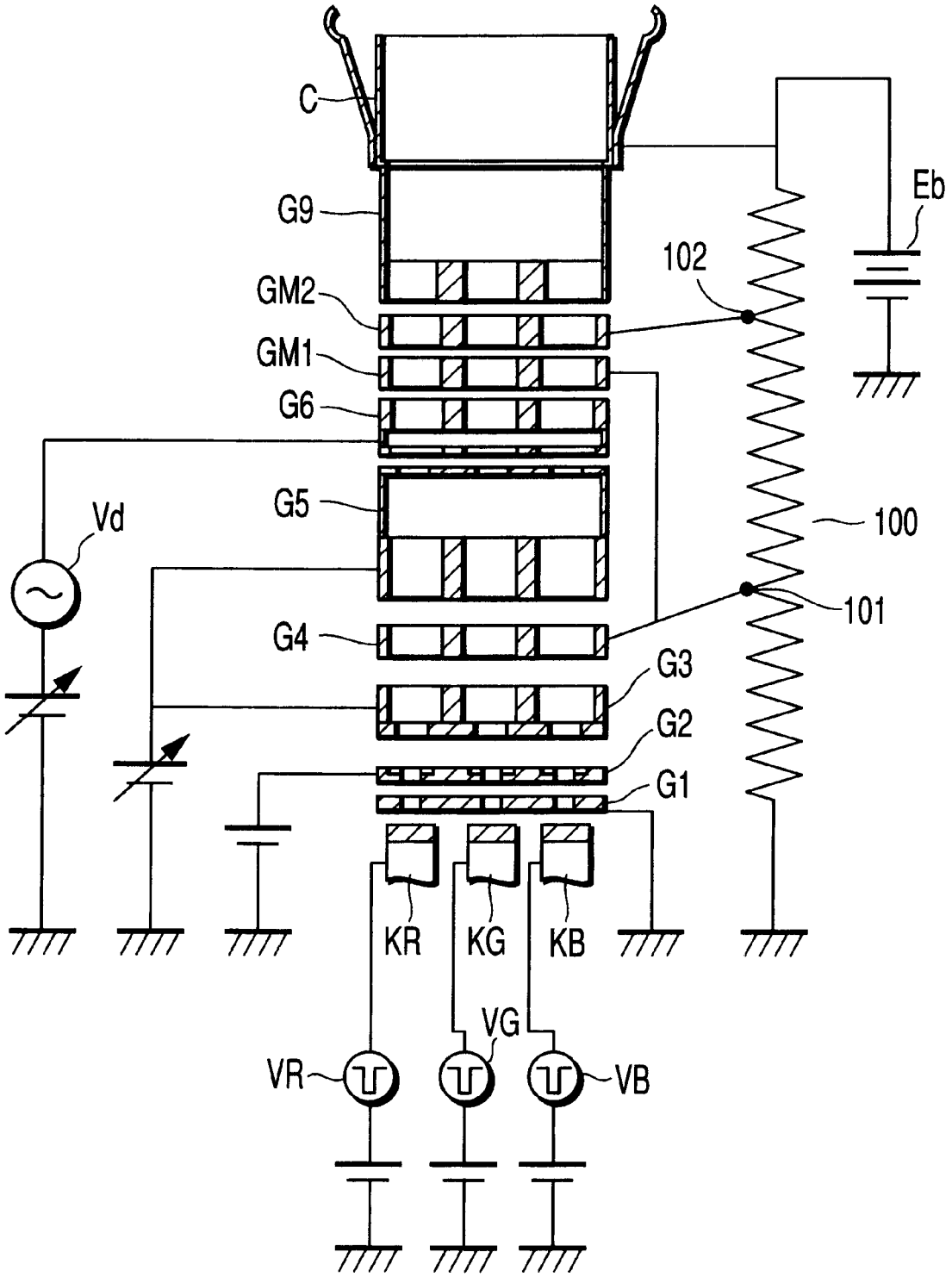
FIG. 12 schematically shows the connection between the respective grids of an electron gun assembly according to another embodiment of the invention.

For example, as shown in FIG. 12, the fourth grid G4 and seventh grid GM1 may be connected within the tube, and these grids may be supplied with a voltage obtained by dividing the anode voltage Eb through the resistor 100.

As has been described above, in order to enhance the lens performance of the electron gun assembly, the CRT apparatus adopts the electric-field expansion type main lens including at least one intermediate electrode between the focus electrode and the anode. In order to converge the center beam and side beams, the center beam is let to enter the main lens substantially in parallel with the tube axis, while the side beams are let to enter the main lens with an inclination. When the electric-field expansion type main lens in which the lens region is substantially extended in the tube axis direction is used, the lens region acting on the side beams become longer than the lens region acting on the center beam. If the center beam is set to be optimally focused on the screen, the side beam is over-focused and blurred.

In order to cope with this problem, the asymmetric lens (quadrupole lens) is disposed on the cathode side of the main lens in the electron gun assembly. The asymmetric lens has a lens power, which is variable in synchronism with the deflection of electron beams, and has, in a relative fashion, a focusing function in the horizontal direction and a diverging function in the vertical direction. The vertical dimension of the center beam passage hole formed in the main-lens-side grid of the asymmetric lens is less than the vertical dimension of the side beam passage hole. Accordingly, the asymmetric lens function of the quadrupole lens acting on the side beam is weaker than the asymmetric lens function acting on the center beam. In other words, the lens function of the asymmetric lens acting on the side beam, compared to the lens function acting on the center beam, has a relatively weak focusing power in the horizontal direction and a relatively strong focusing power in the vertical direction (a relatively weak divergence force).

Accordingly, as regards the horizontal direction, the over-focus lens function of the main lens acting on the side beam can be canceled by the relatively weak focusing power of the asymmetric lens. In addition, the center beam can be optimally focused by the asymmetric lens and main lens. Thereby, the lens functions of the main lens and asymmetric lens acting on the side beams and center beam can be balanced, and the difference in focusing power reduced.

As regards the vertical direction, the center beam is affected by the lens function of the asymmetric lens with the relatively strong focusing power, and the over-focusing by the main lens is increased. The asymmetric lens is disposed on the cathode side of the end face of the plate-shaped electrode of the focus electrode, which is opposed to the intermediate electrode, at a position away by a distance or less, which corresponds to the diameter of the electron beam passage hole formed in the end face of this plate-shaped electrode. The electric field can permeate into the electrode over a distance substantially equal to the diameter of the electron beam passage hole. Thus, the electric field creating the main lens permeates into the cup-shaped electrode located on the cathode side of the focus electrode, through the electron beam passage holes formed in the plate-shaped electrode of the focus electrode that forms the asymmetric lens. The vertical dimension of the center beam passage hole formed in the cup-shaped electrode is less than the vertical dimension of the side beam passage hole. Accordingly, as regards the vertical direction, the focusing power of the main lens acting on the side beam is relatively weaker than the focusing power of the main lens acting on the center beam. Thus, the decrease in the focusing power can cancel the over-focus function of the main lens, which results from the inclined trajectory of the side beam in the main lens, and the relatively strong focusing function of the asymmetric lens.

Specifically, the horizontal over-focusing, which results when the side beam has entered the main lens with an inclination, can be canceled by the difference in diameter between the side beam passage hole and the center beam passage hole formed in the electrode of the asymmetric lens. In addition, the asymmetric lens is disposed at the proper position so that the electric field creating the main lens may permeate into the electron beam passage hole in the electrode of the asymmetric lens. Thus, the vertical over-focusing can be canceled.

The center beam passage hole and side beam passage hole formed in the electrode of the asymmetric lens have the same horizontal dimension. Thus, even if the electric field creating the main lens permeates into the electrode of the asymmetric lens, there is no difference between the focusing powers of the main lens acting on the side beam and center beam.

Accordingly, in the peripheral area of the screen, the occurrence of a blurred beam spot due to the over-focusing of the side beam can be suppressed, and the degradation in resolution can be prevented.

Thereby, the difference in focusing power of the lens functions acting on the center beam and side beams can be reduced, and the center beam and side beams can optimally be focused on the screen. Thus, a substantially uniform beam spot can be obtained over the entire screen.

Therefore, good image characteristics can be obtained and a uniform, high resolution can be obtained over the entire screen.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode-ray tube apparatus including:

an electron gun assembly having an electron beam generating section which generates three electron beams consisting of a center beam and a pair of side beams positioned on both sides of the center beam, and a main lens section which focus the electron beams generated by the electron beam generating section onto a phosphor screen; and a deflection yoke which deflects the electron beams emitted from the electron gun assembly in a horizontal direction and a vertical direction, wherein the main lens section comprises a focus electrode, to which a focus voltage of a first level is applied, an anode, to which an anode voltage of a second level higher than the first level is applied, and at least one intermediate electrode which is disposed between the focus electrode and the anode and to which a voltage of a substantially intermediate level between the first level and the second level is applied, the focus electrode has, in a first end face thereof opposed to the intermediate electrode, three electron beam passage holes for passing the three electron beams, the electron gun assembly includes an asymmetric lens section which has such asymmetry that lens functions of the asymmetric lens section acting on the electron beams are different between the horizontal direction and the vertical direction, and which has a lens power varying in synchronism with the deflection of the electron beams, and the asymmetric lens section is created at a position away by a distance or less, which corresponds to a diameter of the electron beam passage hole formed in said first end face, from the first end face of the focus electrode toward the electron beam generating section, the asymmetric lens section having an asymmetry of a lens function acting on the center beam, which differs from an asymmetry of a lens function acting on the side beams.

2. The cathode-ray tube apparatus according to claim 1, wherein said focus electrode has, in a second end face thereof opposed to a side of the electron beam generating section, three electron beam passage holes for passing the three electron beams, the three electron beam passage holes formed in each of the first and second end faces comprise a center beam passage hole and a pair of side beam passage holes, and a center axis of each of the side beam passage holes in the first end face is made eccentric toward the center beam passage hole, compared to a center axis of each of the side beam passage holes in the second end face.

3. The cathode-ray tube apparatus according to claim 1, wherein at least one of electrodes constituting the asymmetric lens section has a center beam passage hole and a pair of side beam passage holes, which pass the three electron beams, and a vertical dimension of the center beam passage hole is different from a vertical dimension of each of the side beam passage holes.

4. The cathode-ray tube apparatus according to claim 3, wherein the vertical dimension of the center beam passage hole is less than the vertical dimension of each of the side beam passage holes.

5. The cathode-ray tube apparatus according to claim 1, wherein said focus voltage is 20 to 40% of the anode voltage.

6. The cathode-ray tube apparatus according to claim 1, wherein the electron gun assembly is provided with a resistor disposed near the electron gun assembly, and the intermediate electrode is supplied with a voltage obtained by resistor-dividing the anode voltage through the resistor.

7. The cathode-ray tube apparatus according to claim 1, wherein the electron gun assembly includes a prefocus lens section for prefocusing the electron beams generated by the electron beam generating section, and the prefocus lens section has such asymmetry that lens functions of the prefocus lens section acting on the electron beams are different between the horizontal direction and the vertical direction.

8. The cathode-ray tube apparatus according to claim 7, wherein the prefocus lens section has a relatively stronger focusing function in the vertical direction than in the horizontal direction.

9. The cathode-ray tube apparatus according to claim 8, wherein at least one of electrodes constituting the prefocus lens section has three circular electron beam passage holes for passing the three electron beams, and horizontally elongated slits in the vicinity of the respective electron beam passage holes.

10. The cathode-ray tube apparatus according to claim 7, wherein the electron gun assembly is provided with a resistor disposed near the electron gun assembly and a sub-lens section for prefocusing the electron beams which have come out of the prefocus lens section, and at least one of electrodes constituting the sub-lens section is supplied with a voltage obtained by resistor-dividing the anode voltage through the resistor.

11. The cathode-ray tube apparatus according to claim 1, wherein in the asymmetric lens section, the degree of asymmetry of a lens function acting on the center beam is higher than that of asymmetry of a lens function acting on the side beams.

12. The cathode-ray tube apparatus according to claim 11, wherein in the asymmetric lens section, a difference between a focusing power in the vertical direction and a focusing power in the horizontal direction of the lens function acting on the side beams is less than a difference between a focusing power in the vertical direction and a focusing power in the horizontal direction of the lens function acting on the center beam.

* * * * *

UNITED STATES PATENT AND TRADEMARK OFFICE

CERTIFICATE OF CORRECTION

PATENT NO. : 6,646,381 B2
DATED : November 11, 2003
INVENTOR(S) : Hasegawa et al.

It is certified that error appears in the above-identified patent and that said Letters Patent is hereby corrected as shown below:

Title page,
Item [75], Inventors, should read:
-- [75] Inventors: Takahiro Hasegawa, Gyoda (JP);
Junichi Kimiya, Kumagaya (JP);
Syunji Ookubo, Kumagaya (JP);
Hiroyuki Oda, Fukaya (JP) --

Signed and Sealed this

Thirteenth Day of April, 2004

JON W. DUDAS
*Acting Director of the United States Patent and Trademark Office*